US005561923A

United States Patent [19]

Kitanaka

[11] Patent Number: 5,561,923

[45] Date of Patent: Oct. 8, 1996

[54] EXCAVATING APPARATUS

[75] Inventor: Katsumi Kitanaka, Tokyo, Japan

[73] Assignees: Kobe Steel, Ltd., Hyogo; Tomen Kenki Corporation, Osaka-fu, both of Japan

[21] Appl. No.: 357,319

[22] Filed: Dec. 16, 1994

[30] Foreign Application Priority Data

Dec. 20, 1993 [JP] Japan ..... 5-319933

[51] Int. Cl.[6] ..... F02F 5/06

[52] U.S. Cl. ..... 37/352; 37/362

[58] Field of Search ..... 37/347, 348, 352, 37/353, 355, 357; 299/34, 35, 43; 405/258, 267, 303

[56] References Cited

U.S. PATENT DOCUMENTS

| | | | |
|---|---|---|---|
| 3,388,487 | 6/1968 | Peck | 37/352 |
| 4,379,658 | 4/1983 | Schmednecht | 37/347 X |
| 4,843,742 | 7/1989 | Camilleri | 37/362 |
| 5,228,222 | 7/1993 | Holloway et al. | 37/347 X |
| 5,311,683 | 5/1994 | Camilleri | 37/357 X |

FOREIGN PATENT DOCUMENTS

0249231A1 12/1987 European Pat. Off. .

OTHER PUBLICATIONS

Patent Abstracts of Japan, vol. 11, No. 6 (M–551)(2453), 8 Jan. 1987 & JP–A–61 183522 (Goro Toda) 16 Aug. 1986.

*Primary Examiner*—Terry Lee Melius
*Assistant Examiner*—Robert Pezzuto
*Attorney, Agent, or Firm*—Watson Cole Stevens Davis, P.L.L.C.

[57] ABSTRACT

An excavating apparatus for excavating a ditch in the ground, the apparatus including a vehicle (2) and a cutter (22), the cutter being attached slidably to upper and lower horizontal guides (7,8) mounted on the vehicle, and having upper and lower hydraulic cylinders (16,18) to move the cutter (22) relative to the upper and lower horizontal guides (7,8). If the angle of the cutter (22) inclines from the vertical it can be corrected by use of the upper and lower hydraulic cylinders (16,18). During the excavation of a ditch the cutter (22) is driven forward by the hydraulic cylinders (16,18) with the vehicle (2) stationary with the result that an accurate ditch can be excavated.

11 Claims, 5 Drawing Sheets

15
15a
12
27
6
13
10
28
2
5
24
20
14
1
3
4
3
11
15b
22
23
26
25

PRIOR ART

EXCAVATING APPARATUS

The present invention relates to an apparatus for excavating a ditch in the ground for use when constructing an underground continuous wall in civil engineering works.

Previously, in order to construct an underground continuous wall, it was necessary to excavate an elliptical hole, 2 or 3 m (6 or 10 feet) wide, down to a predetermined depth from the ground surface, or to drill into the ground with an auger drill with double or triple lanes down to a predetermined depth, and then to insert a reinforcement cage or steel members. Finally, cement was poured into the hole, or ready mixed concrete was cast in the hole. By repeating this process with successive holes intercepting preceding ones, a continuous underground wall could be constructed.

In the prior method for constructing an underground continuous wall described above, there are some problems as follows. Since the machinery for excavating the holes is about 30 m (100 feet) tall, there is a danger that it may fall over. Secondly, the construction process is complicated, so the construction period is prolonged. Also, a film of muddy water, bentonite or the like is formed where one hole intercepts the preceding section of wall, so a perfect joint cannot be made in order to form a continuous wall. Underground water may leak through the joints after completion of the works. It is therefore difficult to attain simultaneously the objectives of safely and rapidly constructing a wall in the ground which is also perfectly continuous.

Because of these problems, a method of making an underground continuous wall as shown in the schematic views of FIGS. 4 and 5 has been tried. In this method an endless chain type cutter c is disposed on one side of a self-propelled vehicle b having a crawler track a. A continuous ditch is excavated in the ground by advancing the self-propelled vehicle b in the direction of the arrow A of Figs. 4 and 5 while driving the cutter c. Then concrete or cement is poured into the ditch.

However, in use of the above-mentioned apparatus shown in Figs. 4 and 5, problems can arise if the resistance to excavation of the ground is great. Firstly, the endless chain type cutter c inclines from the vertical as shown in Fig. 6. This means the ditch is not properly formed. Also, the crawler $a_1$ on the side of the vehicle b at which the cutter c is located is delayed, and the crawler $a_2$ on the opposite side advances and the vehicle b turns as a whole, as shown by the arrow B in FIG. 7.

It is the aim of the present invention to overcome these and other problems.

The present invention provides an excavating apparatus for excavating a ditch in the ground, the apparatus including a vehicle and a cutter located at one side of the vehicle to extend down into a ditch which is being excavated, characterised by upper and lower horizontal guides mounted on the side of the vehicle and slidably supporting the cutter, and upper and lower piston-cylinder arrangements to move the cutter relative to the upper and lower horizontal guides.

The apparatus according to the present invention enables the cutter to be moved along the horizontal guides by means of the upper and lower hydraulic piston-cylinder arrangements. Consequently, according to the present invention, even if the cutter inclines with respect to the vertical, this can be corrected by separately controlling the upper and lower hydraulic piston-cylinder arrangements.

The invention also provides a method of excavating a ditch using such an excavating apparatus in which the cutter is moved forward in the direction of the ditch being excavated by the upper and lower hydraulic piston-cylinder arrangements with the vehicle stationary, then the cutter is retracted and the vehicle advanced and the process repeated to form a continuous ditch. The invention enables the vehicle to be stationary, or even anchored to the ground, when the cutter is being advanced to excavate the ditch, therefore, the tendency of the vehicle to turn can be eliminated.

The invention will be further understood from the following description, when taken together with the attached drawings, which are given by way of example only, and in which.

Figure 8A:
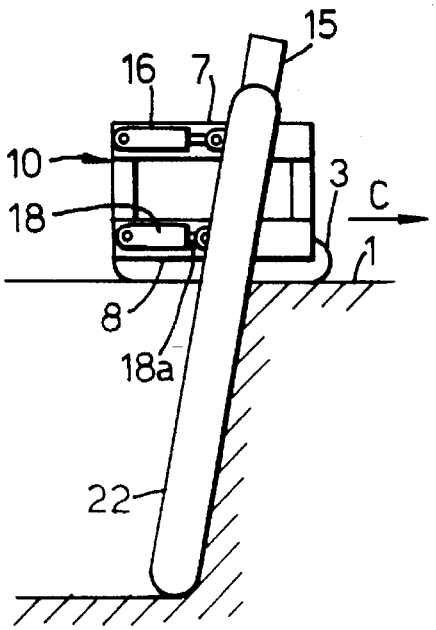
Figure 8B:
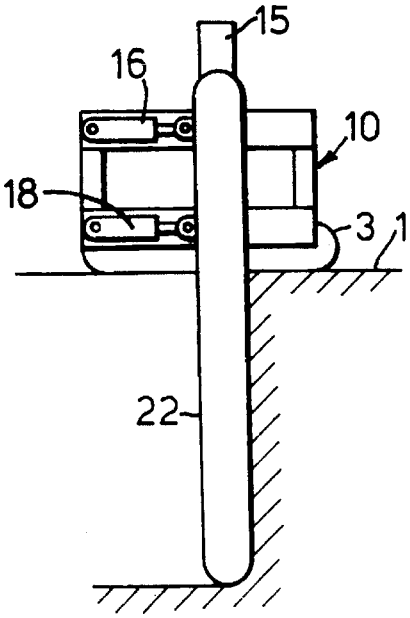
Figure 9:
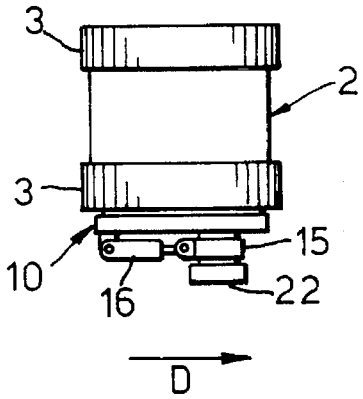

FIGS. 8(*a*) and 8(*b*) are schematic side views for explaining the operation of an apparatus according to the present invention; and FIG. 9 is a schematic plan view for explaining the operation of an apparatus according to the present invention.

Figure 1:
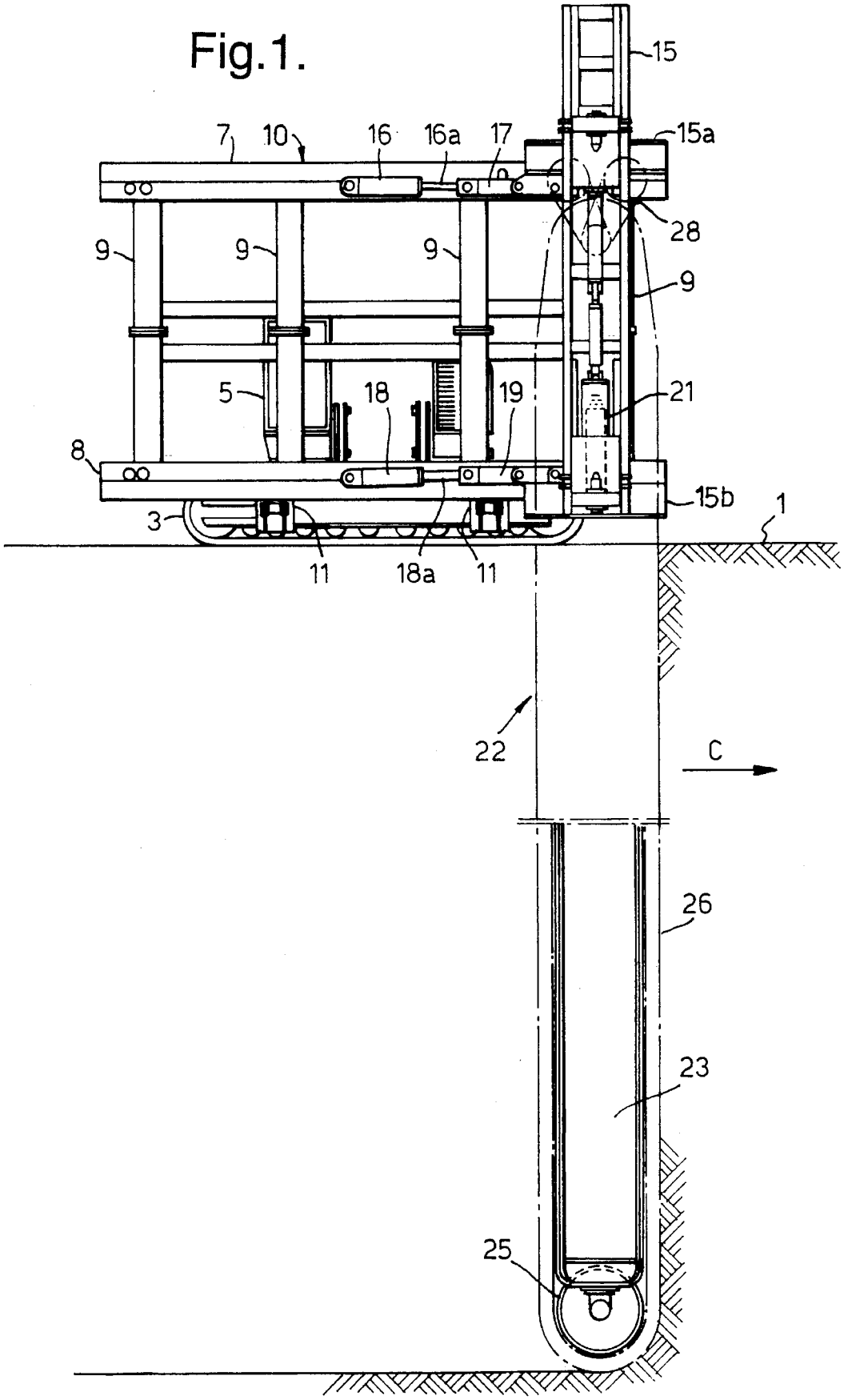
FIG. 1 is a side view of an apparatus according to the present invention.
Figure 2:
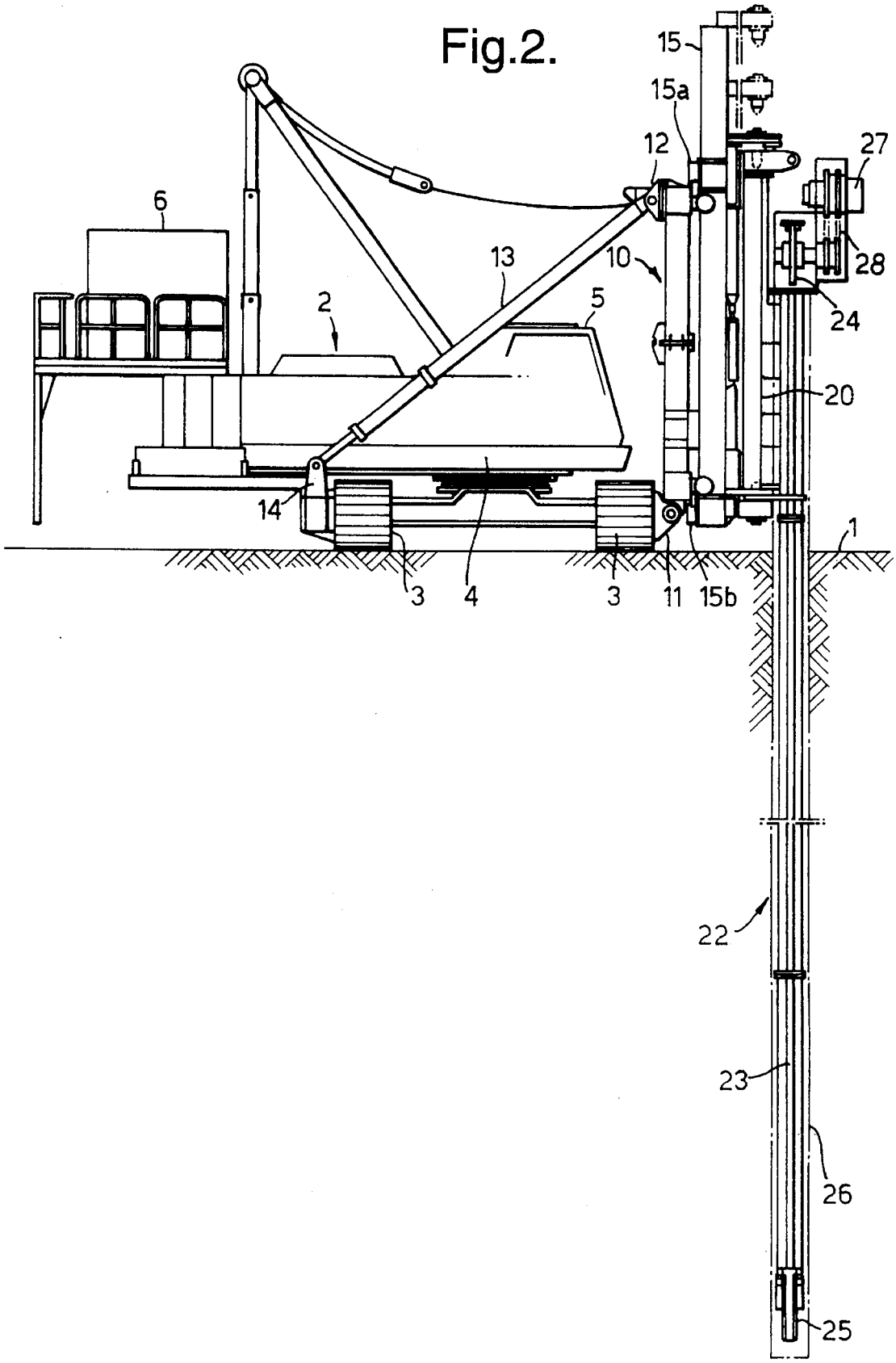
FIG. 2 is a rear view of the apparatus of FIG. 1.
Figure 3:
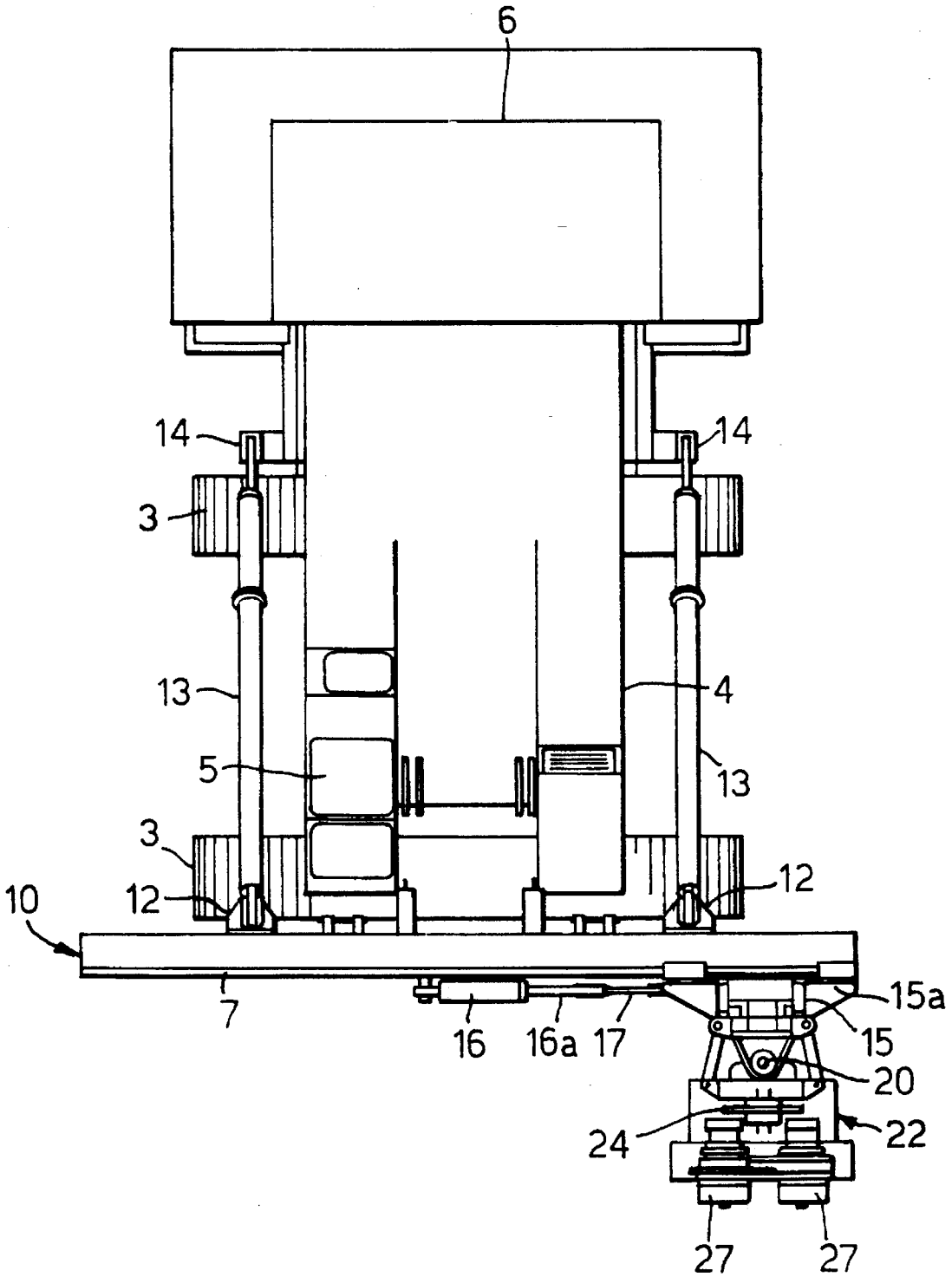
FIG. 3 is a plan view of the apparatus of FIG. 1.
Figure 4:
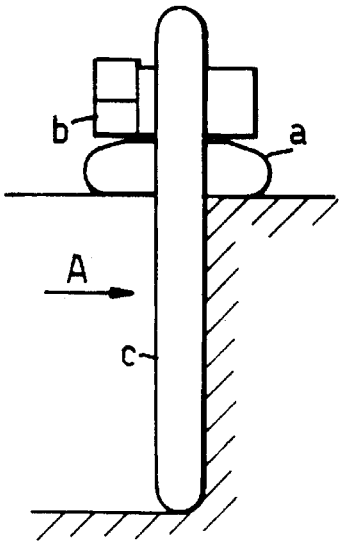
FIG. 4 is a schematic side view of a prior apparatus.
Figure 5:
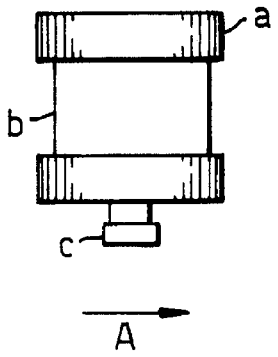
PRIOR ART Fig.5.
FIG. 5 is a schematic plan view of the apparatus of FIG. 4.
Figure 6:
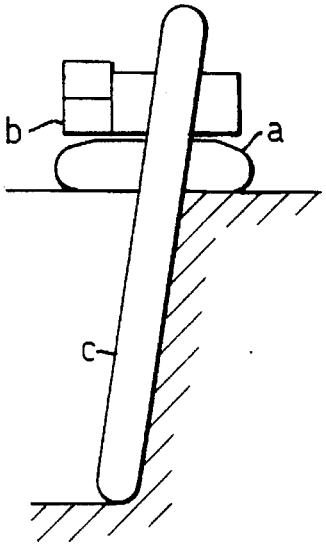
PRIOR ART Fig.6.
FIGS. 6 and 7 are schematic views for explaining the operation of the prior apparatus.
Figure 7:
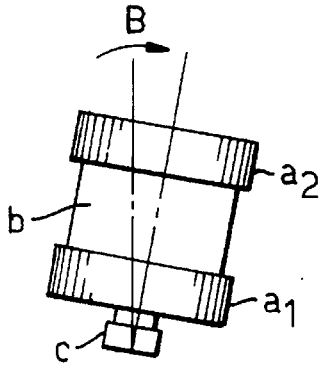
PRIOR ART Fig.7.

An embodiment of the present invention will be described hereinafter with reference to FIGS. 1 to 3. As shown in the Figures, on the ground 1, is located a self-propelled vehicle 2 having crawler tracks 3. This vehicle has a turn table 4 mounted thereon and an operator cabin 5, and a hydraulic power unit 6 arranged at one side.

A first frame 10, formed of an upper horizontal member 7, a lower horizontal member 8 and four vertical members 9, is fixed vertically to one side of the vehicle 2. The lower horizontal member 8 of the frame 10 is attached to two brackets 11 which project outwards beyond the one crawler track at the one side of the vehicle. The upper horizontal member 7 of the frame 10 has brackets 12 connected to stays 13 which are inclined downwards and connected to brackets 14 which project outwards beyond the crawler track on the other side of the vehicle.

A second frame 15 is supported to be slidable in the horizontal direction on the upper and lower horizontal members 7, 8 of the frame 10. Frame 15 is supported by an upper bracket 15*a* which engages slidably with a guide portion of the upper horizontal member 7, and a lower bracket 15*b* which engages slidably with a guide portion of the lower horizontal member 8. The second frame 15 can pivot with respect to the lower bracket portion 15*b* and slide in the substantially vertical direction with respect to upper bracket portion 15*a*.

The rear end of an upper hydraulic cylinder 16 is supported pivotally on the upper horizontal member 7. A tip portion of a piston rod 16*a* of the upper hydraulic piston-cylinder arrangement 16 is connected with an upper portion of the second vertical frame 15 through a connecting member 17. A rear end of a lower hydraulic cylinder 18 is supported pivotally on the lower horizontal member 8. A tip portion of a piston rod 18*a* of the lower hydraulic piston-cylinder arrangement 18 is connected with a lower portion of the second vertical frame 15 through a connecting member 19.

A cutter supporting post 20 is engaged slidably in the vertical direction on the second vertical frame 15. Another hydraulic piston-cylinder arrangement 21 (refer to FIG. 1) is connected between the second frame 15 and the post 20 for raising or lowering the post 20. An endless chain type cutter 22 is disposed vertically on the cutter supporting post 20. The cutter 22 has a post 23 on which are attached upper and lower sprockets 24, 25. An endless chain 26 with excavating bits thereon spans between the upper and lower sprockets. The cutter is driven by a motor 27 using a transmission device 28.

When using the apparatus according to the present invention, constituted as described above, a hole into which the endless chain type cutter 22 can be inserted is excavated down to a predetermined depth in the ground 1 by an earth drill or the like where it is intended to construct an underground continuous wall. With the vehicle positioned such that the horizontal guides 7, 8 lie in the direction in which the ditch is to be excavated, and with the hydraulic cylinder piston rods 16*a*, 18*a* retracted, the cutter 22, attached to the second vertical frame 15 of the apparatus according to the present invention, is lowered into the hole.

If necessary, the vehicle 2 is fixed to the ground 1 by an anchor or the like so that its crawler tracks 3 cannot move. In this state, while the chain 26 of the cutter 22 is driven by the motor 27, pressurised oil is supplied to the hydraulic cylinders 16, 18, and each of the piston rods 16*a*, 18*a* is pushed out. This causes the cutter 22 to move in the direction of the arrow C of FIG. 1 while excavating the ground 1.

When the piston rods 16*a*, 18*a* of the respective hydraulic cylinders 16, 18 have been extended fully, cutting ceases and the piston rods 16*a*, 18*a* are retracted. The vehicle 2 is moved in the direction of the arrow C, on its tracks 3, and the operations described above are performed again. This procedure is repeated thereby to form the ditch for an underground continuous wall.

FIGS. 8(*a*), 8(*b*) and 9 are schematic views for explaining the method of operation of the apparatus according to the present invention, and the same symbols as the symbols described above denote the equivalent components. With this apparatus, even if the cutter 22 inclines from the vertical as shown in FIG. 8(*a*), the cutter 22 can be corrected to be vertical as shown in FIG. 8(*b*) by separately controlling the upper and lower hydraulic cylinders.

Further, in the apparatus according to the present invention, since the excavating operation is carried out using the operation of the hydraulic cylinders 16, 18 in the state in which the vehicle 2 is stationary, there is less tendency for the vehicle 2 to move and become misaligned during the excavating operation. Also, when there is a fear that the vehicle 2 may move, because the excavating resistance is great, anchors or the like can be driven into the ground 1 and movement of the vehicle 2 thus prevented. Consequently, according to the present invention, the ditch can be excavated correctly in the predetermined direction as shown by the arrow D in FIG. 9.

I claim:

1. An excavating apparatus for excavating a ditch, said excavating apparatus comprising:

a vehicle having a side on which upper and lower horizontal guides are mounted;

a cutter comprising upper and lower brackets slidably attached to the upper and lower horizontal guides, respectively, the guides slidably supporting the cutter; and upper and lower hydraulic means for independently moving the upper and lower brackets, respectively, relative to the upper and lower horizontal guides.

2. An excavating apparatus according to claim 1, further comprising means for separately controlling said upper and lower hydraulic means.

3. An excavating apparatus according to claim 1, wherein said cutter further comprises a frame to which said upper and lower brackets are attached, a cutter support post attached slidably on the frame, and another hydraulic means for moving the cutter support post relative to the frame.

4. An excavating apparatus according to claim 1 wherein the vehicle further comprises means for moving the vehicle.

5. An excavating apparatus according to claim 4, wherein the means for moving comprises crawler tracks.

6. An excavating apparatus according to claim 1, wherein the cutter is an endless chain type cutter.

7. A method of excavating a ditch using an excavating apparatus according to claim 1, said method comprising:

(a) moving said cutter forward in a direction of excavation of the ditch by operation of the upper and lower hydraulic means with the vehicle stationary;

(b) retracting the cutter and advancing the vehicle; and repeating steps (a) and (b) to form the ditch continuously.

8. A method of excavating a ditch according to claim 7, wherein step (a) comprises fixing the vehicle by means of an anchor.

9. A method of constructing an underground continuous wall by excavating said ditch according to the method of claim 7, and pouring cement or concrete in said ditch.

10. A method of constructing an underground continuous wall by excavating said ditch according to the method of claim 8, and pouring cement or concrete in said ditch.

11. An excavating apparatus according to claim 1, wherein:

a first one of said upper and lower brackets is pivotally attached to said cutter; and a second one of said upper and lower brackets is slidingly attached to said cutter.

* * * * *